United States Patent [19]

Miller

[11] 4,348,172

[45] Sep. 7, 1982

[54] PORTABLE PROPANE GAS HAND TORCH

[76] Inventor: Harry C. Miller, One Security Dr., Nicholasville, Ky. 40356

[21] Appl. No.: 172,716

[22] Filed: Jul. 28, 1980

[51] Int. Cl.[3] ..... F23Q 7/12

[52] U.S. Cl. ..... 431/255; 431/345

[58] Field of Search ..... 431/254, 255, 256, 264, 431/344, 345, 353; 310/339; 361/260

[56] References Cited

U.S. PATENT DOCUMENTS

| | | | |
|---|---|---|---|
| 3,220,459 | 11/1965 | Wilson | 431/255 |
| 3,280,881 | 10/1966 | Hach, Jr. et al. | 431/255 |
| 3,388,962 | 6/1968 | Baumann et al. | 431/344 |
| 3,436,164 | 4/1969 | Deucher | 431/255 |
| 3,574,506 | 4/1971 | Locke | 431/344 |
| 3,667,895 | 6/1972 | Ross | 431/255 |

*Primary Examiner*—Samuel Scott
*Assistant Examiner*—Lee E. Barrett
*Attorney, Agent, or Firm*—Mason, Fenwick & Lawrence

[57] ABSTRACT

A portable gas hand torch igniter and burner assembly of the piezoelectric-type to be assembled onto a portable pressurized gas fuel cylinder which includes a handgrip housing body having an internal cavity gas conduit network, and an elongated burn tube having a venturi portion at its inlet end and an end-tapered orifice cylinder removably mounted in the venturi portion. A gas pressure regulator valve mechanism maintains a substantially constant predetermined gas supply pressure level at the inlet portion of said gas conduit network and a control valve associated with a push button normally closes the conduit network against passage of gas to the burn tube. A piezoelectric igniter in said housing body is actuated by inward depression of the push button to open the control valve to admit gas to the burn tube and generate a spark-producing voltage a predetermined short interval after opening of the control valve to produce a spark within the burn tube.

16 Claims, 7 Drawing Figures

17d
18
23
17
22
16
8
30
11i
15a
11c
34
11
9
4
18
17d
23
22
17
16
34
41a
4

18
17d
17b
17
23
17a
22
16
30
11h
11i
34a
34
11c
10

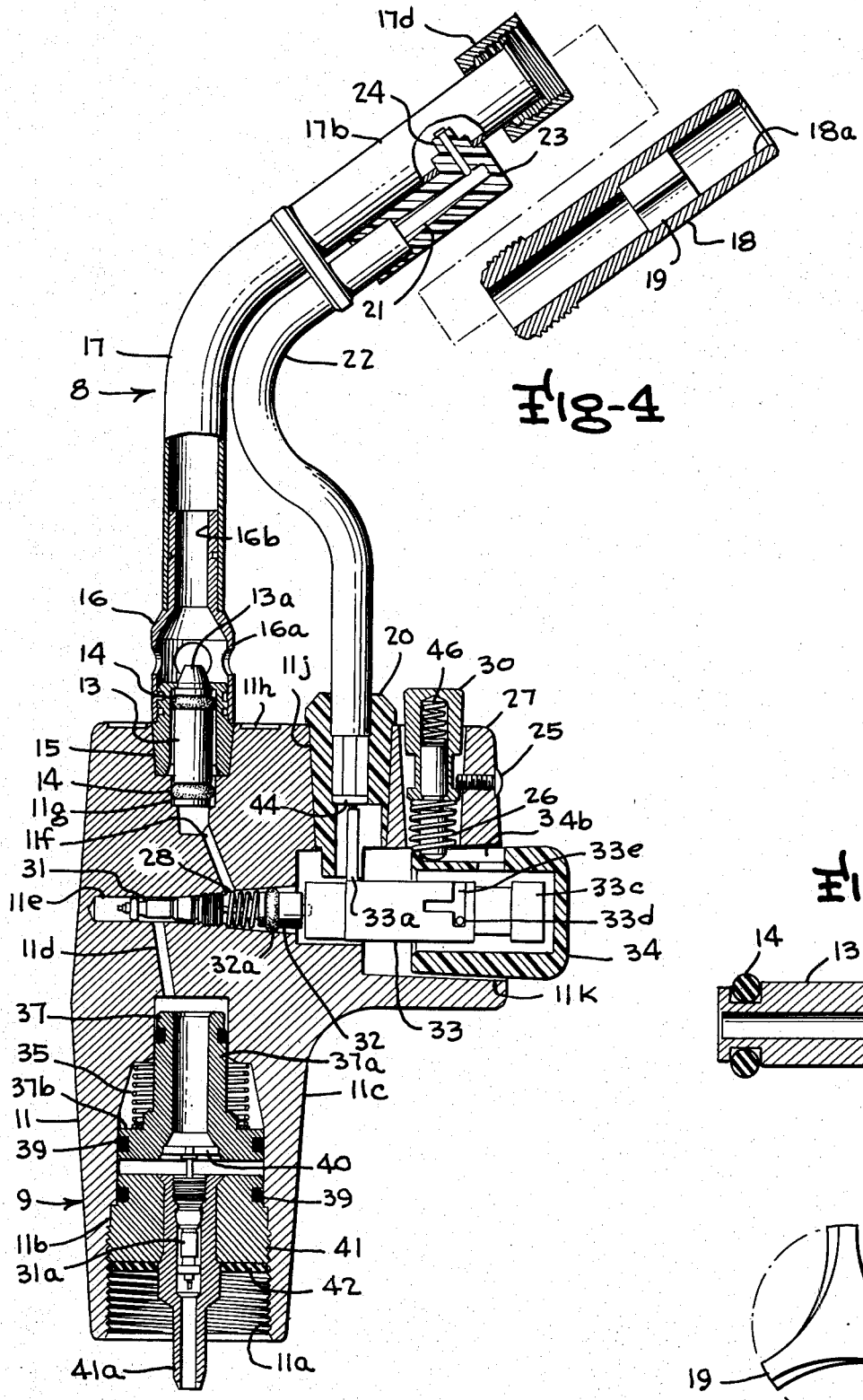
Fig-4
Fig-6
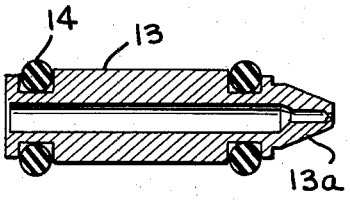
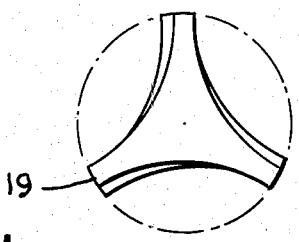
Fig-7

PORTABLE PROPANE GAS HAND TORCH

BACKGROUND AND OBJECTS OF THE INVENTION

The present invention relates in general to piezoelectric-type portable propane gas hand torches, and more particularly to such piezoelectric igniter-type gas hand torches having finger actuated mechanical structure for activating the piezoelectric spark-producing device solely responsive to mechanical hand pressure and valving the gas to flow into the burner tube immediately prior to spark generation to insure proper ignition.

Piezoelectric spark-producing devices for use in igniting combustible fuels such as propane gas and similar fuels which can be stored in portable containers have been known for a number of years. Such devices typically have a hammer which is moved into force impact with an anvil structure of a piezoelectric crystal assembly forming part of an electrical circuit having a spark gap. When the crystal is deformed by the hammer blow, a voltage is generated in the circuit of sufficient magnitude to create a spark in the gap area of the circuit. Typical of such piezoelectric spark-producing devices are those shown in prior U.S. Pat. Nos. 3,509,388 dated Apr. 28, 1970 and 4,139,792 dated Feb. 13, 1979, both assigned to Matsushita Electric Industrial Co., Ltd. In those devices, the hammer is actuated by moving a slidable finger-piece or plunger slidably supported in telescoping relation projecting into the outer housing, which during an initial portion of its inward stroke arms a spring while restraining the hammer against movement towards the crystal, and then suddenly releases the hammer to be driven by the spring into spark generating impact with the crystal stack. Other mechanical arrangements have also been devised in prior art piezoelectric-type spark-producing devices for driving the hammer into spark generating impact with the crystal structure.

Other similar devices have been proposed, as U.S. Pat. No. 3,802,828 granted Apr. 9, 1974 to Mercer et al, wherein the hammer is driven by a piston which responds to fluid pressure from the combustible fuel source, in a manner which ensures that the gaseous fuel has reached the combustion chamber portion of the burner by the time the hammer is allowed to impact against the crystal and produce the spark for igniting the fuel in the burner.

An object of the present invention is the provision of a novel portable finger-activated gas hand torch with a piezoelectric igniter, wherein the igniter is associated with a finger-operated control knob in a novel manner facilitating manufacure and reliable operation of the torch, and which provides improved safety features insuring igniting of the gaseous fuel from the attached container and operation only while safely in the hands of the user maintaining the control knob in depressed condition by finger-pressure, thus ensuring automatic extinguishing of the torch if it is dropped or finger-pressure is released from the control knob for any reason.

Another object of the present invention is the provision of a novel portable gas hand torch of the piezoelectric igniter-type, as described in the immediately preceding paragraph, wherein the action of the igniter and the valve controlling release of gaseous fuel to the combustion chamber of the burner tube reliably operate in a manner such that gaseous fuel reaches the combustion zone of the burner tube immediately prior to spark generation.

Yet another object of the present invention is the provision of a novel portable gas hand torch of the piezoelectric igniter-type, constructed in such manner that the torch may be used upside down or in any position without flare-out of flame or significant changes in flame pattern and wherein the control knob which in its ON position must be maintained depressed to continue the burning condition the burning condition is spring biased to cause shut off of gas fuel supply so that the torch will not be accidentally maintained in burning condition when accidentally overturned or rolling on surfaces onto which it may be dropped.

Other objects, advantages and capabilities of the present invention will become apparent from the following detailed description, taken in conjunction with the accompanying drawings illustrating a preferred embodiment of the invention.

BRIEF DESCRIPTION OF THE FIGURES

FIG. 4 is a vertical section view, to enlarged scale, of the control head and burner tube assembly, taken predominantly along the line 4—4 of FIG. 3;

FIG. 6 is a longitudinal section view of the orifice member; and

FIG. 7 is an end elevation view of the helix member.

DETAILED DESCRIPTION OF A PREFERRED EMBODIMENT

Figures 1, 2, 3:
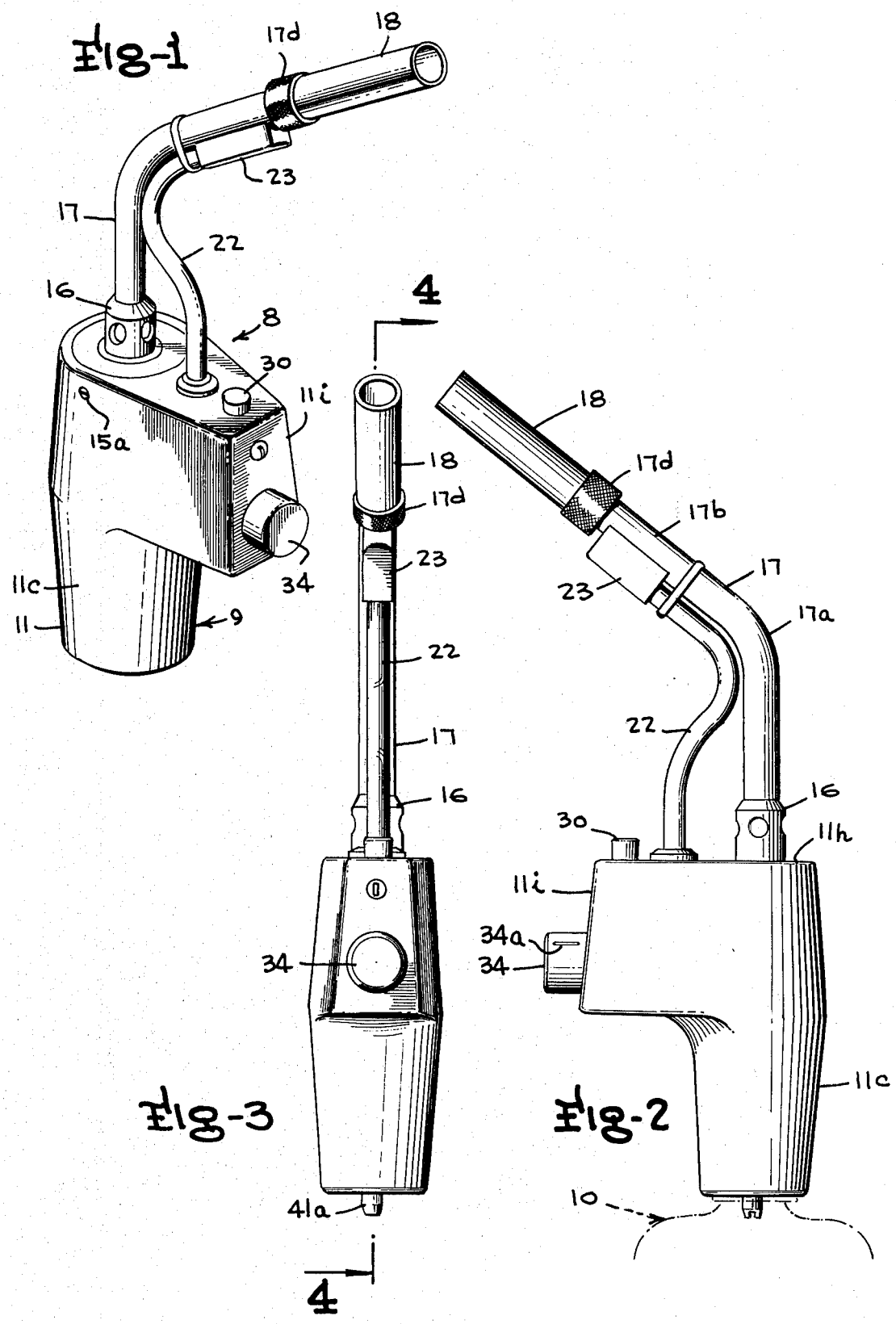
FIG. 1 is a perspective view of a portable hand-held propane torch of the piezoelectric igniter-type, assembled with a propane tank, embodying the present invention.
FIG. 2 is a side elevation view of the portable hand torch handgrip control head and burner tube assembly portion of the torch.
FIG. 3 is a front elevation view of the portion shown in FIG. 2.
Figure 5:
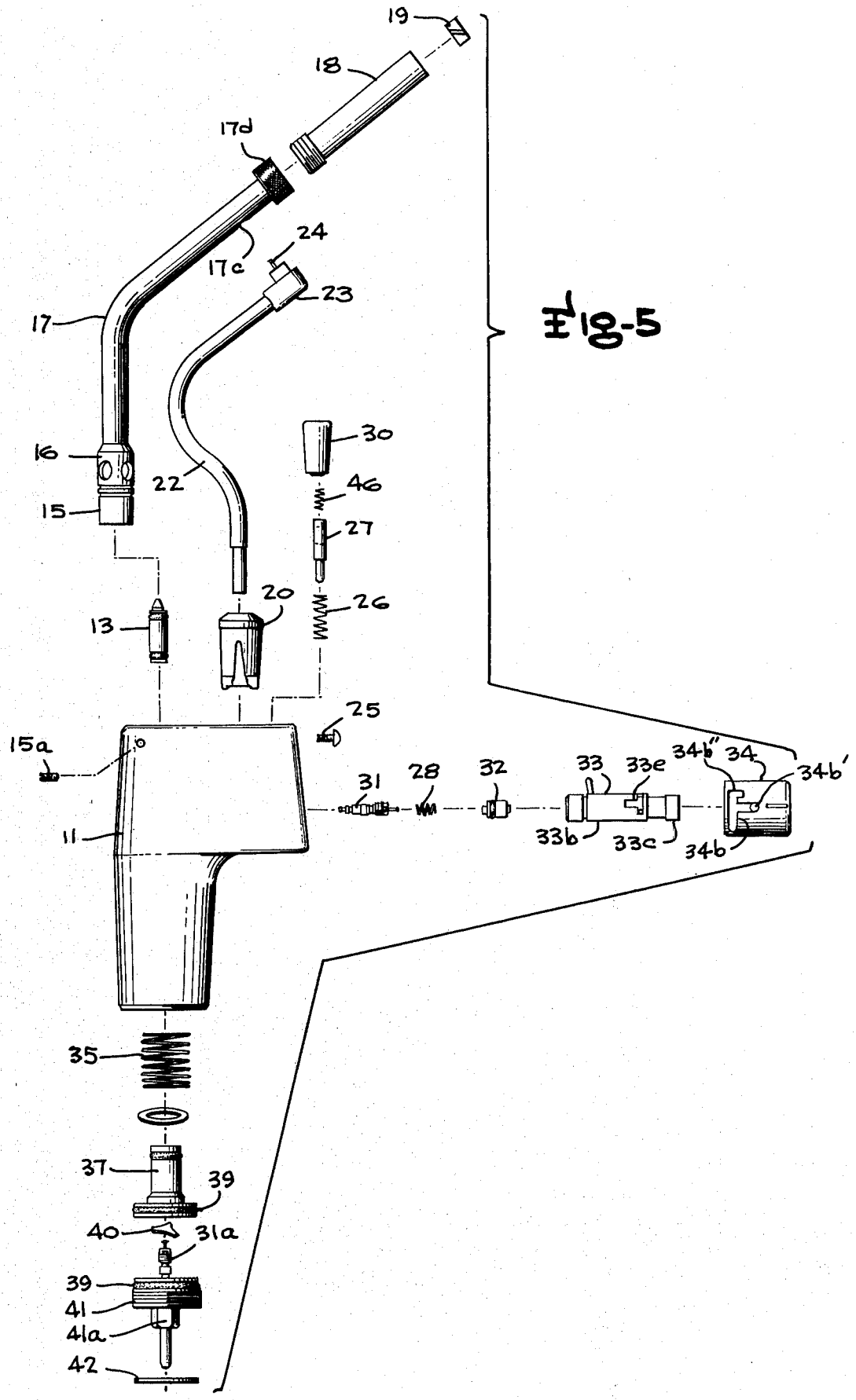
FIG. 5 is an exploded elevation view of the hand torch.

Referring to the drawings, wherein like reference characters designate corresponding parts throughout the several figures, the portable propane gas hand torch of the piezoelectric-type embodying the present invention is indicated generally by the reference character 8, and is generally made-up of a handgrip control head and burner tube assembly forming the upper portion thereof, indicated generally by the reference character 9, assembled onto a conventional liquified propane tank or cylinder 10. The upper control head and burner tube assembly 9 comprises a handgrip-shaped main body 11 having an internally threaded entrance portion 11*a* to a cavity 11*b* opening downwardly through the lower handgrip-shaped portion 11*c* of the body 11, to be threaded onto the conventional neck of the propane gas container or tank 10 to form a changeable tank assembly therewith. The body 11 is preferably a metal molded body, and includes a plurality of interconnected passages and cavities, formed generally by the gas passage 11*d* communicating with the cavity 11*b* and with a manually activated control valve cavity 11*e*, which in turn communicates with gaseous fuel passage 11*f* which extends to a main orifice housing cavity 11*g* opening through the top surface 11*h* of the enlarged upper portion 11*i* of the body 11. The cavity 11*g* houses the orifice member 13 defining the exit orifice for the fuel from the container or tank 10, having, for example, the cross-sectional shape shown in FIG. 6, providing a pair of external circumferential grooves concentric with the axis of the passage through the orifice member 13 in which are seated a pair of O-rings 14 to form seals about the exterior of the orifice member 13 in the smaller diameter lower portion of the cavity 11*g* and against the walls of the central bore of the orifice adapter member 15 which is releasibly held by screw 15*a* in the enlarged upper portion of the cavity 11*g* in the body 11. Surmounted on the orifice adapter 15 is the shaped tubular venturi member 16 having a large diameter portion 16*a* encircling the truncated conical upper nozzle portion 13*a* of the orifice member 13 with laterally facing openings therein as shown, and having a smaller diameter upper, substantially cylindrical portion 16*b* tightly fitted in the lower end portion of the burn tube 17 having a bend 17*a* near its midregion and providing a straight exit end section 17*b* as shown apertured at 17*c* near the uppermost end thereof.

Removably held on the upper end portion 17*b* of the burn tube 17 by threaded collar 17*d* is a tubular cylindrical burn tip 18 positioned with its downstream or inlet end tightly against the outlet end of the burn tube 17 and having a helix or flame divider structure 19 near the midregion of the bore 18*a* of the cross-sectional configuration shown in FIG. 7, to impart some helical swirl to the flame passing through the burn tip 18.

The enlarged upper portion 11*i* of the body 11 includes another upwardly opening, frusto-conical cavity 11*j*, communicating with an enlarged cavity portion 11*k* for a control knob, later described, joining with the valve chamber 11*e*, in which is tightly fitted an insulator 20. The insulator 20 houses and supports the lower end portion of a conduit 22 for the igniter wire 21. The wire 21 at the upper end of the curved conduit 22 extends into an electrode housing 23 of insulating material having an electrode 24 therein connected to and projecting at right angles from the upper end portion of the wire 21 and extending into exposed position in the burner tube 17 near its outlet end as shown. The lower end of the wire 21 below the lower end of the conduit 22 within the bore of the insulator 20 is in electrical contact with a contact cap 44 which engages and is in electrical communciation with the ignition electrode 33*a* of the piezoelectric-type igniter 33, which in the preferred embodiment is an igniter having the construction shown in previously mentioned U.S. Pat. Nos. 3,509,388 or 4,139,792.

The piezoelectric spark generating device or igniter 33, as will be apparent from a review of either U.S. Pat. Nos. 3,509,388 or 4,139,792, includes a stationary housing portion indicated at 33*b*, (the left-hand portion of the igniter shown in FIG. 4) which houses the piezoelectric crystal stack and in which the finger-actuated slide plunger member 33*c* slides. A transverse pin 33*d* in the hammer portion rides in what appears as a substantially T-shaped slot 33*e* in FIG. 4, projecting laterally from the hammer through a cam slot in one or both sides of the plunger 33*c*. The lower portion of the T-shaped slot 33*e* as viewed in FIG. 4, in which the pin initially is located, restrains the pin and thus the hammer against movement during initial inward movement of the plunger (to the left as viewed in FIG. 4) while a spring within the plunger is compressed. At a predetermined position during the inward or leftward stroke of the plunger, inclined surfaces of the cam slot in the plunger sidewalls cam the pin upwardly to the horizontal portion of the T-slot 33*e* as viewed in FIG. 4, releasing the hammer to impact against the crystal and produce the momentary high-voltage which is conducted through the electrode 33*a* and wire 21 to the electrode tip 24 within and near the discharge end of the burn tube 17. The inwardmost end, or left end portion as viewed in FIG. 4, of the piezoelectric spark igniter device bears against an actuator 32 surrounded by an O-ring 32*a* to form a seal against the surrounding wall of the cavity in which the actuator resides, and the actuator bears against a spring 28 whose other end engages the plunger pin of valve core 31 controlling the emission of gaseous fuel from the passage 11*d* to the passage 11*f* and into the region of the venturi formed at the outlet of the orifice device 13.

The plunger end portion of the igniter device 33 is surrounded by a rotatably adjustable and axially movable control knob 34 which projects from the right-hand end of the enlarged portion 11*i* of the body 11. The control knob 34 has an index mark 34*a* on its surface as viewed in FIG. 2 and is rotatably adjustable about its axis between an OFF position, an ON position and a CLEAN position. In the ON position, a slot 34*b* paralleling the center axis of the control knob and located in its periphery in upwardly facing position at the ON position of the knob, aligns with the lower end portion of a lock button assembly formed of a vertically movable lock button 30 in a suitably shaped cavity in the body 11 projecting from the top of the body 11, and having a bore in which are seated a lock button spring 46 and a shaft 27 surrounded by a spring 26 compressed between the lower end of the lock button 30 and the top of the control knob 34. The lock button is normally restrained within its cavity with the lower end portion of the shaft 27 extending into the slot 34*b* by a lock button screw 25 threaded into the body 11.

A regulator valve and piston assembly is housed in the downwardly opening bottom cavity 11*b* of the body 11 and, as illustrated, comprises a regulator piston 37 having a substantially cylindrical smaller diameter upper portion which is movable axially within the uppermost portion of the cavity 11*b* substantially conforming in diameter to the smaller diameter piston portion, while the lower portion of the regulator piston is of larger diameter as indicated at 37*b* and corresponds substantially to the diameter of the portion of cavity 11*b* in which it moves. O-rings 39 are provided in grooves in the regulator piston portions 37*a* and 37*b* as shown to seal against the confronting wall portions of the cavity 11*b*. A center bore passes axially through the regulator piston 37, and is shaped at the lower end portion of the center bore to receive a spider-like contact plate 40 having, for example, three outwardly extending legs to engage in the shaped portions of the center passage through the regulator piston 37 in which it is seated, while its center portion engages the plunger pin of the regulator valve core 31*a*. For example, a valve core such as the 5344 valve core made by Schrader Automotive Products Division of Scovill Manufacturing Co., of the type used with refrigerants such as R-12 and R-22, having an internal spring biasing the plunger pin to resiliently maintain the valve core in closed condition, may be used for both valves 31 and 31*a*.

The regulator valve core 31*a* is threaded into and carried by a regulator valve body insert 41*a* carried within a regulator valve body member 41 as shown, and having a gasket 42 against the lower face thereof. The regulator valve body 41 has external threads for threading it into the internal threaded portion 11*a* of the cavity 11*b* and also has an O-ring 39 to form a seal near the upper end of the regulator valve body member 41. After positioning of the regulator valve body member 41 and its associated valve body insert 41*a* within the cavity 11*b*, the lower end portion of the body 11 can then be assembled onto the threaded neck of the conventional propane container or tank with the gasket 42 forming a seal against the rim of the container neck and the regulator valve body insert 41*a* engaging and depressing the customary control valve pin internally incorporated in the container neck to open the internal propane container valve and communicate the propane gas through slot passages in the lower end portion of the valve body insert 41*a* communicating with the center bore of the insert to admit the propane gas to the regulator valve core 41*a*. The pressure regulator assembly in the cavity 11*b* including the regulator valve core 41*a* with its plunger pin bearing against the center portion of the contact plate 40 in the piston 37 which is spring-biased by the piston spring 35, is constructed so as to change the higher pressure in the propane cylinder or container to a lower consistent approximately 36 p.s.i. (+ or −3 pounds) for operation of the torch.

When the control knob 34 is in the OFF position, the lower end portion of the spring-biased shaft 27 assembled with the lock button 30 lies in a portion of the control knob groove 34*b* which restrains the control knob in its outermost position illustrated in FIG. 4. When the control knob 34 is rotated to the ON position, the portion 34*b*′ of the control knob slot which extends parallel to the center axis of the control knob aligns with the lock button shaft 27, permitting the control knob to be depressed inwardly against the spring bias of the internal spring in the igniter 33 and against the bias of the actuator spring 28. Inward axial movement of the control knob 34 in the ON position moves the igniter 33, actuator 32 and the plunger pin of the control valve core 31 just enough to release the propane gas for travel through the orifice 13*a* and burn tube 17 to the location of the electrode 24 before the piezo-crystal igniter 33 is depressed enough to produce the electric current for generating the spark. When the hammer of the piezoelectric igniter 33 releases by camming of its pin to alignment with its release slot, the impact of the hammer against the piezo-crystal portion produces an electric current that travels up through the wire 21 in the conduit 22 to the electrode 24 and jumps from the end of the electrode to the inside of the burn tube, causing a spark that ignites the gas.

To torch is designed to facilitate cleaning to remove any clogging of the orifice in a novel manner. If the orifice becomes blocked due to contamination, burner tube 17 and venturi structure 16 and orifice adapter 15 can be removed by loosening the orifice adapter screw shown at 15*a*, the orifice member 13 can then be removed and reversed, and the burner tube, venturi and orifice adapter reassembled. The control knob 34 may then be shifted to the CLEAN position, wherein a short axial portion 34*b*″ of the slot 34*b* aligns with the lock button shaft 27 which will permit a slight amount of inward movement of the control knob 34, igniter 33 and actuator 32 sufficient to depress the plunger pin of valve core 31 and admit some gas pressure to the passage 11*f*, but the control knob stroke is insufficient to activate the igniter to produce a spark. When the control knob is pressed to the extent allowed by the slot 11*b* at the CLEAN position, gas pressure is admitted through the orifice member in the reverse direction to achieve cleaning of the orifice by the pressurized gas. The components can then be reassembled to the original positions to resume normal operation.

I claim:

1. A portable gas hand torch igniter and burner assembly of the piezoelectric-type to be assembled onto a portable pressurized gas fuel cylinder, comprising a handgrip housing body having upper and lower cavities opening through top and bottom wall portions thereof respectively and an interconnecting gas conduit network therebetween, the lower cavity forming an internally threaded gas inlet to be threaded onto the neck of the fuel cylinder for rigidly mounting the housing body thereon, an elongated burn tube having a venturi portion at its inlet end and an end-tapered orifice cylinder removably mounted in the venturi portion, means removably supporting said venturi portion and orifice cylinder in said upper cavity for rigidly mounting the burn tube on said housing body, a gas pressure regulator valve mechanism adjustably supported in said lower cavity for maintaining a substantially constant predetermined gas supply pressure level at the inlet portion of said gas conduit network, means forming a valve chamber intercepting said gas conduit network having a control valve therein normally closing the conduit network against passage of gas to the burn tube, a push button on the housing body supported for rectilinear axial movement along an axis intercepting the control valve from a normal outward position projecting from the housing body, piezoelectric igniter means in said housing body having a case portion movable along said axis responsive to inward depression of said push button for opening said control valve to admit gas to the burn tube and having a plunger portion movable relative to its case portion responsive to such push button depression to activate the igniter to generate a spark-producing voltage a predetermined short interval after opening of the control valve, an electrode means extending from the igniter to a location within the burn tube near its exit end forming a spark gap with the burn tube for igniting the gas admitted thereto upon opening of said control valve.

2. A portable gas hand torch assembly as defined in claim 1, wherein said control valve and valve chamber are interposed between inlet and outlet conduit portions of said conduit network and include a valve member and plunger pin movable along the movement axis of said push button and igniter plunger portion to close and open gas communication between said conduit portions.

3. A portable gas hand torch assembly as defined in claim 1, wherein said control valve and valve chamber are interposed between inlet and outlet conduit portions of said conduit network and include a valve member and plunger pin movable along the movement axis of said push button and igniter plunger portion to close and open gas communication between said conduit portions, and said movement axis of said push button and plunger portion and plunger pin being disposed horizontally and in perpendicular intercepting relation to a vertical axis through said upper and lower cavities when the inlet end portion of said burner tube is arranged veritcally.

4. A portable gas hand torch assembly as defined in claim 1, wherein said push button is of hollow cup-shaped configuration defining a well opening toward and receiving said plunger portion nested therein, the igniter movable case portion having a control valve actuator in abutment therewith for moving the control valve to valve opening position upon depression movement of the push button through a distance insufficient to activate the igniter to spark-generating condition.

5. A portable gas hand torch assembly as defined in claim 2, wherein said push button is of hollow cup-shaped configuration defining a well opening toward and receiving said plunger portion nested therein, the igniter movable case portion having a control valve actuator in abutment therewith for moving the control valve plunger pin to valve opening position upon depression movement of the push button through a distance insufficient to activate the igniter to spark-generating condition.

6. A portable gas hand torch assembly as defined in claim 3, wherein said push button is of hollow cup-shaped configuration defining a well opening toward and receiving said plunger portion nested therein, the igniter movable case portion having a control valve actuator in abutment therewith for moving the control valve plunger pin to valve opening position upon depression movement of the push button through a distance insufficient to activate the igniter to spark-generating condition, and spring means between said control valve and said actuator biasing the actuator and igniter and push button toward the normal outward position of the push button.

7. A portable gas hand torch assembly as defined in claim 1, wherein said push button has a first axially elongated slot in a side thereof for receiving a limit pin formation therein in a first "on" angular position of the push button permitting axial push button travel sufficient to open the control valve and activate the igniter to spark-producing condition, the push button having a second slot of shorter axial length paralleling the first slot for receiving the limit pin at a second "clean" angular position allowing control valve opening push button travel insufficient to activate the igniter, and said orifice cylinder being reversibly housed in the venturi portion of the burn tube enabling reversing of the orifice assembly upon removal and reassembly in the burn tube and depression of the push button in "clean" position to admit pressurized gas to the reversed orifice cylinder and dislodge debris without activating the igniter.

8. A portable gas hand torch assembly as defined in claim 3, wherein said push button has a first axially elongated slot in a side thereof for receiving a limit pin formation therein in a first "on" angular position of the push button permitting axial push button travel sufficient to open the control valve and activate the igniter to spark-producing condition, the push button having a second slot of shorter axial length paralleling the first slot for receiving the limit pin at a second "clean" angular position allowing control valve opening push button travel insufficient to activate the igniter, and said orifice cylinder being reversibly housed in the venturi portion of the burn tube enabling reversing of the orifice assembly upon removal and reassembly in the burn tube and depression of the push button in "clean" position to admit pressurized gas to the reversed orifice cylinder and dislodge debris without activating the igniter.

9. A portable gas hand torch assembly as defined in claim 4, wherein said push button has a first axially elongated slot in a side thereof for receiving a limit pin formation therein in a first "on" angular position of the push button permitting axial push button travel sufficient to open the control valve and activate the igniter to spark-producing condition, the push button having a second slot of shorter axial length paralleling the first slot for receiving the limit pin at a second "clean" angular position allowing control valve opening push button travel insufficient to activate the igniter, and said orifice cylinder being reversibly housed in the venturi portion of the burn tube enabling reversing of the orifice assembly upon removal and reassembly in the burn tube and depression of the push button in "clean" position to admit pressurized gas to the reversed orifice cylinder and dislodge debris without activating the igniter.

10. A portable gas hand torch assembly as defined in claim 6, wherein said push button has a first axially elongated slot in a side thereof for receiving a limit pin formation therein in a first "on" angular position of the push button permitting axial push button travel sufficient to open the control valve and activate the igniter to spark-producing condition, the push button having a second slot of shorter axial length paralleling the first slot for receiving the limit pin at a second "clean" angular position allowing control valve opening push button travel insufficient to activate the igniter, and said orifice cylinder being reversibly housed in the venturi portion of the burn tube enabling reversing of the orifice assembly upon removal and reassembly in the burn tube and depression of the push button in "clean" position to admit pressurized gas to the reversed orifice cylinder and dislodge debris without activating the igniter.

11. A portable gas hand torch assembly as defined in claim 1, wherein said pressure regulator valve mechanism includes a spring biased piston member in the uppermost portion of said lower cavity having a central through passage and an abutment therein and an externally threaded valve carrier threaded into said lower cavity adjustable in angular position to vary force on a valve member actuator of said regulator valve by said abutment and maintain selected source pressure levels in the inlet portion of said conduit network.

12. A portable gas hand torch assembly as defined in claim 3, wherein said pressure regulator valve mechanism includes a spring biased piston member in the uppermost portion of said lower cavity having a central through passage and an abutment therein and an externally threaded valve carrier threaded into said lower cavity adjustable in angular position to vary force on a valve member actuator of said regulator valve by said abutment and maintain selected source pressure levels in the inlet portion of said conduit network.

13. A portable gas hand torch assembly as defined in claim 4, wherein said pressure regulator valve mechanism includes a spring biased piston member in the uppermost portion of said lower cavity having a central through passage and an abutment therein and an externally threaded valve carrier threaded into said lower cavity adjustable in angular position to vary force on a valve member actuator of said regulator valve by said abutment and maintain selected source pressure levels in the inlet portion of said conduit network.

14. A portable gas hand torch assembly as defined in claim 6, wherein said pressure regulator valve meachanism includes a spring biased piston member in the uppermost portion of said lower cavity having a central through passage and an abutment therein and an externally threaded valve carrier threaded into said lower cavity adjustable in angular position to vary force on a valve member actuator of said regulator valve by said abutment and maintain selected source pressure levels in the inlet portion of said conduit network.

15. A portable gas hand torch assembly as defined in claim 7, wherein said pressure regulator valve mechanism includes a spring biased piston member in the uppermost portion of said lower cavity having a central through passage and an abutment therein and an externally threaded valve carrier threaded into said lower cavity adjustable in angular position to vary force on a valve member actuator of said regulator valve by said abutment and maintain selected source pressure levels in the inlet portion of said conduit network.

16. A portable gas hand torch assembly as defined in claim 10, wherein said pressure regulator valve mechanism includes a spring biased piston member in the uppermost portion of said lower cavity having a central through passage and an abutment therein and an externally threaded valve carrier threaded into said lower cavity adjustable in angular position to vary force on a valve member actuator of said regulator valve by said abutment and maintain selected source pressure levels in the inlet portion of said conduit network.

* * * * *